US012104235B2

(12) United States Patent
Binder et al.

(10) Patent No.: US 12,104,235 B2
(45) Date of Patent: Oct. 1, 2024

(54) PIECE OF JEWELRY

(71) Applicant: EGF—EDUARD G. FIDEL GMBH, Pforzheim (DE)

(72) Inventors: Kai-F. Binder, Pforzheim (DE); Avni Bajraktari, Pforzheim (DE)

(73) Assignee: EGF—EDUARD G. FIDEL GMBH, Pforzheim (DE)

( * ) Notice: Subject to any disclaimer, the term of this patent is extended or adjusted under 35 U.S.C. 154(b) by 104 days.

(21) Appl. No.: 17/801,946

(22) PCT Filed: Oct. 26, 2021

(86) PCT No.: PCT/EP2021/079653

§ 371 (c)(1),
(2) Date: Aug. 24, 2022

(87) PCT Pub. No.: WO2022/122242

PCT Pub. Date: Jun. 16, 2022

(65) Prior Publication Data

US 2023/0110717 A1 Apr. 13, 2023

(30) Foreign Application Priority Data

Dec. 9, 2020 (DE) ..... 10 2020 132 870.2

(51) Int. Cl.

| | |
|---|---|
| ***C22C 5/02*** | (2006.01) |
| ***A44C 9/00*** | (2006.01) |
| ***C22C 1/02*** | (2006.01) |

(52) U.S. Cl.

CPC ..... *C22C 5/02* (2013.01); *A44C 9/00* (2013.01); *C22C 1/02* (2013.01)

(58) Field of Classification Search

CPC ..... C22C 5/02; C22C 1/02; A44C 9/00

See application file for complete search history.

(56) References Cited

U.S. PATENT DOCUMENTS

2021/0045507 A1* 2/2021 Colomer ..... C22F 1/14

FOREIGN PATENT DOCUMENTS

| | | | | |
|---|---|---|---|---|
| CA | 2247783 | A1 * | 3/1999 | ..... A61K 6/046 |
| CH | 715 203 | A1 | 1/2020 | |
| DE | 199 58 800 | A1 | 1/2001 | |
| DE | 100 27 605 | A1 | 12/2001 | |
| DE | 603 10 555 | T2 | 12/2007 | |
| DE | 20 2010 011 820 | U1 | 11/2010 | |
| DE | 10 2011 009 625 | A1 | 3/2012 | |
| JP | 63-169345 | A | 7/1988 | |
| JP | 9-184033 | A | 7/1997 | |
| JP | 2005-82890 | A | 3/2005 | |
| JP | 2017122249 | A * | 7/2017 | |

OTHER PUBLICATIONS

International Search Report, issued in PCT/EP2021/079653, dated Jan. 4, 2022.

Okazaki et al., "Corrosion Resistance of Dental Alloys in Pseudo-Oral Environment", Marerials Transactions, 2001, vol. 42, No. 2, pp. 350 to 355.

Susz et al., "18 Carat White Gold Jewellery Alloys—Some Aspects of Their Metallurgy," Gold Bulletin, vol. 13, 1980, pp. 15-20.

* cited by examiner

*Primary Examiner* — Jack W Lavinder

(74) *Attorney, Agent, or Firm* — Birch, Stewart, Kolasch & Birch, LLP

(57) ABSTRACT

A piece of jewelry has a copper-containing gold alloy which consists of 75.0 to 75.2 wt. % gold, 16.5 to 17.0 wt. % copper, 3.1 to 7.1 wt. % silver, 1.2 to 3.2 wt. % palladium, and a remainder containing 0.5 to 2.5 wt. % zinc.

12 Claims, No Drawings

PIECE OF JEWELRY

The invention relates to a jewelry body, such as a piece of jewelry, in particular a ring-shaped piece of jewelry, a part of a piece of jewelry or a semi-finished product for manufacturing a piece of jewelry according to the generic term of claim 1, a jewelry alloy for manufacturing such a jewelry body and a method for manufacturing the jewelry alloy. The jewelry body is manufactured from a gold alloy containing copper.

From DE60310555T2 an alloy for manufacturing watch, ornamental and jewelry articles is known, which has a gold content of at least 75 wt. % and a copper content of at least 14 wt. %. It is further described how a colour shade from red via pink to yellow can be achieved in such gold alloys depending on the contents of copper and silver.

There is a need on the jewelry market for alloys which, in addition to the known coloured gold alloys, make new colour variations possible, in particular in the manufacture of gold jewelry, and which are relatively inexpensive to produce.

From JP2005082890A, a gold alloy is known which, in addition to the main content of gold, has a copper content of 18 to 20 wt. %, a silver content of 2 to 5 wt. %, a palladium content of 1.5 to 2.5 wt. % and a zinc content of 0.4 to 0.6 wt. %. The alloy creates a pink-based colour shade.

The object of the invention is to provide a novel colouring for a generic jewelry body and to ensure good workability, such as in a continuous casting method.

This object is achieved by the jewelry body made of a copper-containing gold alloy with the features of claim 1. The gold alloy consists of at least 75.0 to a maximum of 75.2 wt. % gold, at least 16.5 to a maximum of 17.0 wt. % copper, at least 3.1 to a maximum of 7.1 wt. % silver, at least 1.2 to a maximum of 3.2 wt. % palladium, and a balance having at least 0.5 to a maximum of 2.5 wt. % zinc, whereby a jewelry body with a novel colour shade that can be referred to as champagne-coloured is obtained.

In a particularly advantageous embodiment, the alloy consists of at least 75.0 to a maximum of 75.2 wt. %, in particular 75.1 wt. % gold, 16.5 to 17.0 wt. % copper, 3.1 to 7.1 wt. % silver, 1.2 to 3.2 wt. % palladium, and a balance having between 0.8 and 1.1 wt. % zinc. With such a composition, a particularly intense champagne colour can be achieved and particularly good workability of the gold-copper alloy can be ensured.

Furthermore, the above object is achieved by a method in which the zinc content of the alloy is at least partially obtained by melting brass together with the other constituents. In this way, the zinc content of the melt can be produced in a particularly simple manner.

In this case, the molten brass is advantageously formed by Cu63Zn37 brass, whereby the desired content of zinc can be melted particularly easily and in an exact quantity.

After the manufacture of the corresponding melt, it is advantageous if this is cast by hand in order to be able to also manufacture small or particularly filigree jewelry bodies in the champagne shade.

Alternatively or additionally thereto, the melt can be supplied to a continuous casting method, particularly in the case of larger quantities, in order to be able to manufacture, for example, semi-finished products that can be used for later processing into pieces of jewelry, such as for the manufacture of fully or partially champagne-coloured jewelry rings.

A preferred composition of the melt for manufacturing the jewelry alloy and the jewelry body with a particularly radiant champagne colour shade is given below:

EXAMPLE 75.1 wt. % gold,
15.1 wt. % copper,
5.1 wt. % silver,
2.2 wt. % palladium,
2.5 wt. % CuZn37 brass

The invention claimed is:

1. A jewelry body made of a copper-containing gold alloy, wherein the copper-containing gold alloy consists of:
75.0 to 75.2 wt. % gold,
16.5 to 17.0 wt. % copper,
3.1 to 7.1 wt. % silver,
1.2 to 3.2 wt. % palladium, and
0.5 to 2.5 wt. % zinc.

2. The jewelry body according to claim 1, wherein the copper-containing gold alloy consists of:
75.0 to 75.2 wt. % gold,
16.5 to 17.0 wt. % copper,
3.1 to 7.1 wt. % silver,
1.2 to 3.2 wt. % palladium, and
0.8 to 1.1 wt. % zinc.

3. A jewelry alloy for manufacturing the jewelry body according to claim 2.

4. The jewelry body according to claim 2, wherein the copper-containing gold alloy consists of:
75.1 wt. % gold,
16.5 to 17.0 wt. % copper,
3.1 to 7.1 wt. % silver,
1.2 to 3.2 wt. % palladium, and
0.8 to 1.1 wt. % zinc.

5. A jewelry alloy for manufacturing the jewelry body according to claim 4.

6. A jewelry alloy for manufacturing the jewelry body according to claim 1.

7. A method for manufacturing the jewelry alloy according to claim 6, comprising:
obtaining the copper-containing gold alloy by melting brass together with the gold, copper, silver and palladium.

8. The manufacturing method according to claim 7, wherein the brass is melted in a form of CuZn37.

9. The manufacturing method according to claim 8, wherein the copper-containing gold alloy is cast by hand after the copper-containing gold alloy has been manufactured.

10. The manufacturing method according to claim 8, wherein the copper-containing gold alloy is supplied to a continuous casting method after the copper-containing gold alloy has been manufactured.

11. The manufacturing method according to claim 7, wherein the copper-containing gold alloy is cast by hand after the copper-containing gold alloy has been manufactured.

12. The manufacturing method according to claim 7, wherein the copper-containing gold alloy is supplied to a continuous casting method after the copper-containing gold alloy has been manufactured.

* * * * *